US005427734A

United States Patent [19]

Yamashita et al.

[11] Patent Number: 5,427,734

[45] Date of Patent: Jun. 27, 1995

[54] PROCESS FOR PREPARING R-FE-B TYPE SINTERED MAGNETS EMPLOYING THE INJECTION MOLDING METHOD

[75] Inventors: Osamu Yamashita, Ibaraki; Masahiro Asano; Tsunekazu Saigo, both of Kita katsuragi, all of Japan

[73] Assignee: Sumitomo Special Metals Co., Ltd., Osaka, Japan

[21] Appl. No.: 80,771

[22] Filed: Jun. 24, 1993

[30] Foreign Application Priority Data

| | | | |
|---|---|---|---|
| Jun. 24, 1992 | [JP] | Japan | 4-191727 |
| Jun. 24, 1992 | [JP] | Japan | 4-191728 |
| Oct. 1, 1992 | [JP] | Japan | 4-289420 |
| Oct. 1, 1992 | [JP] | Japan | 4-289421 |
| Oct. 1, 1992 | [JP] | Japan | 4-289422 |
| Feb. 9, 1993 | [JP] | Japan | 5-046010 |
| Mar. 30, 1993 | [JP] | Japan | 5-097190 |

[51] Int. Cl.[6] ..... B22F 1/02; B22F 3/16

[52] U.S. Cl. ..... 419/23; 419/26; 419/35; 419/36; 419/37; 419/38; 419/39; 419/44; 419/45; 419/46; 419/54

[58] Field of Search ..... 419/23, 25, 26, 35, 419/36, 37, 38, 39, 44, 45, 46, 53, 54

[56] References Cited

U.S. PATENT DOCUMENTS

| | | | |
|---|---|---|---|
| 4,113,480 | 9/1978 | Rivers | 75/214 |
| 4,770,723 | 9/1988 | Sagawa et al. | 148/302 |
| 4,902,361 | 2/1990 | Lee et al. | 148/302 |

FOREIGN PATENT DOCUMENTS

| | | |
|---|---|---|
| 61-220315 | 9/1986 | Japan . |
| 62-37302 | 2/1987 | Japan . |
| 62-252919 | 11/1987 | Japan . |
| 6428302 | 1/1989 | Japan . |
| 6428303 | 1/1989 | Japan . |

*Primary Examiner*—Donald P. Walsh
*Assistant Examiner*—Chrisman D. Carroll
*Attorney, Agent, or Firm*—Watson, Cole, Grindle & Watson

[57] ABSTRACT

The object of the invention is to provide a manufacturing method of a complex shaped R—Fe—B type sintered anisotropic magnet improved the moldability of injection molding and preventing the reaction between R ingredients and binder and controlled the degradation of magnetic characteristics due to residual carbon and oxygen. Utilizing the R—Fe—B type alloy powder or the resin coated said alloy powder, and methylcellulose and/or agar and water, instead of the usual thermoplastic binder, it is mixed and injection molded. The molded body is dehydrated by the freeze vacuum dry method to control the reaction between R ingredients and of the R—Fe—B alloy powder and water; furthermore, by administering the de-binder treatment in the hydrogen atmosphere, and sintering it after the dehydrogen treatment, residual oxygen and carbon in the R—Fe—B sintered body is drastically reduced, improving the moldability during the injection molding to obtain a three dimensionally complex shape sintered magnet.

35 Claims, No Drawings

PROCESS FOR PREPARING R-FE-B TYPE SINTERED MAGNETS EMPLOYING THE INJECTION MOLDING METHOD

BACKGROUND OF THE INVENTION

1. Field of the Invention

This invention relates to a method of manufacturing R—Fe—B type sintered permanent magnets. The methylcellulose and/or the agar and water mixture as a binder which induces a sol-gel reaction at a specified temperature with a R—Fe—B type alloy pulverized powder is injection molded in a magnetic field; and after the obtained molded body is dehydrated and debinded, the molded body is sintered. Thus, this invention provides a method of manufacturing a R—Fe—B type sintered magnet which controls the amount of residual carbon and oxygen in the sintered body, improving the moldability of injection molding while preventing the degradation of magnetic characteristic, and which can provide a three-dimentionally complex shaped sintered magnet.

2. Description of the Prior Art

Today, it is required to have smaller and lighter as well as high performance small motors and actuators for household appliances, computer peripherals, and automobiles, etc. Also, it is not only required to have smaller, lighter, and thinner magnet material, but it is also required to have magnet material with a three dimensionally complex shaped product with installation of a concave-convex magnet surface at a specified place and with a through hole, etc.

As high performance permanent magnets, R—Fe—B type sintered permanent magnets (U.S. Pat. No. 4,770,223, JP-A-59-46008, JP-B- 61-34242) and a R—Fe—B type bond magnet (U.S. Pat. No. 4,902,361) were proposed.

Since the above R—Fe—B type permanent magnet as well as R—Fe—B type bond magnet usually require compression molding in the magnetic field during a manufacturing process, only a simple shaped molded body is obtained. However, in order to respond to today's requirements to have various shapes, it is proposed to study an injection molding method, which has been widely used in many engineering fields, as a method to manufacture the above R—Fe—B type sintered magnet. For example, a manufacturing method of a R—Fe—B type sintered permanent magnet (J P-A-61-220315, JP-A-62-252919, JP-A-64-28303) is proposed. An alloy powder which is obtained by pulverizing a R—Fe—B type alloy ingot and a binder which contains thermoplastic resin such as polyethylene and polystyrene, etc. as kneaded and injection molded; after the debinder treatment, the molded body is sintered to obtain the magnet. Also, a manufacturing method of a R—Fe—B type sintered permanent magnet which employs an injection molding method (JP-A-64-28302) utilizing paraffin type wax as a binder is proposed.

However, generally, intermetallic compounds containing a rare earth element (R) are likely to react with elements such as O, H, C, etc., and when binders such as thermoplastic resin and paraffin wax, etc. that are used in the above injection molding method are added to a R—Fe—B type alloy powder ad kneaded, the carbon and oxygen content usually increases due to the reaction with R. Thus, even after injection molding, the debinder treatment, and sintering, the considerable amount of carbon and oxygen remain in a sintered magnet. This results especially in degradation of magnetic characteristics, and remains an obstacle to application of a complex shaped product by injection molding to magnet parts.

Also, the above mentioned binder which is utilized in the usual the injection molding method is mixed with an alloy powder and heated to the melting point which is around 100° C.~200° C. to melt the binder in the injection molding machine. Since the curie temperature (Tc) of R—Fe—B type permanent magnets is about 300° C.~350 C., it is difficult to orientate an alloy powder to the magnetizing direction when it is heated close to the curie temperature. Also, there was a problem of requiring a large magnetizing current in orientation.

Therefore, having studied binders with low melting points; hitherto, as a binder in the compression molding for Co type super alloy powder for injection molding, a composition which comprises 1.5~3.5 wt % methylcellulose in the said alloy powder and a specified amount of additives, glycerin and boric acid, is proposed (U.S. Pat. No. 4,113,480). Also, as binder for the injection molding for $Y_2O_3$—$ZrO_2$ and alumina powder, a mixture of 10~50 wt % agarose, agar in the said alloy powder, and to which deionized water and glycol are added is proposed (U.S. Pat. No. 4,734,237). Furthermore, as a binder for injection molding of alloy powder for tools, a special composition wherein water, plasticizers such as glycerine, etc., lubricants and mold releasing agents such as wax emulsion, etc. are added to 0.5–2.5 wt % methylcellulose was proposed (JP-A-62-37302).

However, in the above mentioned binder of which the main ingredients are methylcellulose and agar, in order to maintain the required fluidity and molding body strength, a relatively large amount as described above is used. Also, since it is necessary to add the equal amount of binder additives, for example, plasticizer as glycerin, etc. as methylcellulose, the considerable amount of carbon and oxygen remains even after injection molding and the debinder treatment and sintering. It resulted in degradation in magnetic characteristics of a R—Fe—B type permanent magnet, and remains an obstacle to application of a complex shaped part by the injection molding method to a magnetic parts.

SUMMARY OF THE INVENTION

This invention concerns with a manufacturing method of a R—Fe—B type permanent magnet, wherein injection molding and sintering and employed; furthermore, it prevents the reaction between R elements and a binder and degradation of magnetic characteristics due to residual carbon and oxygen in the molded body. It does not require a large magnetizing current during the injection molding in the magnetic field, by improving the injection moldability to obtain a complex shaped, particularly, R—Fe—B type sintered anisotropic magnets for small products.

DETAILED DESCRIPTION OF PREFERRED EMBODIMENTS

The inventors have selected agar and/or methylcellulose as a binder which can keep the die temperature at less that 100° C. during the injection molding, which can inhibit the reaction between R elements in a R—Fe—B type alloy powder and the binder, and decrease the amount of residual carbon and oxygen. Furthermore, as a result of studying its applicability to a R—

Fe—B type alloy powder, the inventors found that as long as the R—Fe—B type alloy powder is of a specified average particle size, though it contains a large amount of water, even the methylcellulose concentration is less than 0.5 wt %, the sufficient fluidity and the molded body strength are obtained. Also, the similar effect was observed when less than 4.0 wt % of agar was utilized. The inventors found that not only less than specified amounts of methylcellulose and agar are required, but the amount of lubricant can be as small as less than 0.30 wt %. Furthermore, the same phenomena and effects were observed when agar and methylcellulose were combined as a binder.

That is to say, the inventors investigated various methods to inhibit the reaction between the R elements in R—Fe—B type alloy powder and the binder, and to limit the reduced carbon and oxygen in the molded body. As the result of such studies, instead of utilizing the thermoplastic binder which is usually utilized as a binder in the hitherto employed injection molding method, binders such as methylcellulose and agar which make a sol-gel transformation at a specified temperature or the mixture of which and water, and utilizing a small amount of lubricant, sufficient viscoelasticity is obtained even the majority of the binder is water. Thus, the carbon content in the total binder is drastically reduced, and while the moldability during injection molding is improved, it turns into gel within a die below 100° C. during injection molding, and it is possible to mold into a specified shape. The further dehydration treatment and the debinder treatment eliminate nearly all remaining oxygen and carbon in the molded body. Thus, the obtained sintered body has a drastically reduced amount of oxygen and carbon, and a three dimensionally complex shaped magnet with superior magnetic properties was obtained.

Also, considering that a large amount of water exists in the binder, the inventors, coated the surface of the R—Fe—B type alloy powder with a resin prior to mixing with the above binder to inhibit the reaction between water and R elements in the alloy powder, to prevent oxidation of the alloy powder in various treatments after mixing them, and to decrease the amount of residual carbon in the obtained sintered body. The inventors found that the moldability during the injection molding is improved so that a three dimensionally complex shaped sintered magnet was obtained; and since almost all coated resin can be eliminated by the debinder treatment, the residual carbon in the sintered body did not increase.

Also, the inventors, after investigating a method to maximally inhibit the reaction between R elements of magnetic powder particles and a binder to obtain stable magnetic properties, particularly, when utilizing a R—Fe—B type alloy powder consisting of a main ingredients alloy powder and a liquid phase alloy powder, a specified amount of transition metal pulverized powder is mixed with the said alloy powder, and after coating the surface of magnetic powder by the mechanofusion process in the inert atmosphere, the coating is made closely and uniform with the surface diffusion by heat treatment to completely isolate R elements of magnetic powder particles from the binder during intermediate processes: the binder kneading, injection molding, debinder and sintering processes. Thus, the inventors found that the reaction between the R elements and the binder was prevented.

Furthermore, the inventors found that, even the binder contains a large amount of water, dehydration after the injection molding can be accomplished easily by the heat drying method, and since almost all water evaporates as the temperature rises to 100° C. the dehydration treatment in excess of 100° where a R—Fe—B type alloy powder activates is not necessary. Also, the dehydration treatment by the freeze vacuum dry method is possible, and since at the temperature where the R—Fe—B type alloy powder becomes active already oxygen which is generated from a large amount of water is eliminated, the oxidation of R—Fe—B type alloy powder was significantly controlled.

Also, regarding the debinder treatment after the dehydration process, the inventors found that by utilizing the vacuum heating method or heating in the hydrogen atmosphere and keeping it at a specified temperature, almost all carbon in methylcellulose and agar binders or in resin coatings are decarbonized; and the inventors also found that treatment time was drastically reduced in comparison to the usual binder consisting of paraffin wax and thermoplastics.

Regarding this invented process of preparing for R—Fe—B type sintered magnet based upon various facts, detailed descriptions: The R—Fe—B type alloy raw material powder, the resin coating the said alloy powder, the composition of methylcellulose and agar which consists as a binder, etc.; furthermore, the main process, injection molding process, the dehydration process, and the debinder processing conditions are given below.

In this invention, as a R—Fe—B type alloy powder, the desirable average particle size is about 1~10 μm which comprises principal component of 8 at. %~30 at. % R (provided R contains at least one of rare earth elements including Y), 42 at. %~90 at. % Fe, 2 at. %~28 at. % B; furthermore, it is most desirable to have the pulverized powder particle size of around 1~6 m.

Rare earth element R (provided R contains at least one of rare earth elements including Y) is desirable to contain least one of Nd, Pr, Ho, and Tb, or one of La, Sm, Ce, Er, Eu, Pm, Tm, Yb, and Y. When R is less than 8 at. % the crystalline structure will be cubical structure with the identical structure as α-Fe, strong magnetic characteristics, especially the high coercive force can not be obtained. When R exceeds 30 at. %, it results in many R-rich non magnetic phases which lower the residual magnetic flux density(Br), and the magnet with superior magnetic characteristics can not be obtained. Therefore, the desired concentration range for R is 8 at. %~30 at. %.

When the amount of B is less than 2 at. %, the crystalline structure becomes rhombohedral structure, and the high coercive force can not be obtained. When the amounts of B exceeds 28 at. %, there will be many B rich non-magnetic phases, superior permanent magnets can not be obtained due to the low residual magnetic flux density. Therefore, the desired composition range for B is 2 at. %~28 at. %.

When the amount of Fe is less than 42 at. %, the residual magnetic flux density decreases, but when it exceeds 80 at. % the high coercive force can not be obtained; therefore, the desirable composition range for Fe is 42 at. %~90 at. %. Also, in this invention, the replacement of Fe by Co improves temperature characteristics without degrading the obtained magnet's magnetic characteristics, but exceeding 50% replacement of Co for Fe, is not desirable since it results in degradation of magnetic characteristics.

Also, if one of the additive elements listed below is added, the coercive force, etc. and the manufacturability will improve, enabling the low cost production of a Fe-B-R type permanent magnet. Ti, Ni, V, Nb, Ta, Cr, Mo, W, Mn, AI, Sb, Ge, Sn, Zr, Bi, Hf, Cu, Si, S, C, Ca, Mg, P, H, Li, Na, K, Be, Sr, Br, Ag, Zn, N, F, Se, Te, and Pb.

However, the addition of excess amount will decrease the residual magnetic flux density (Br), m and lower the maximum energy product; therefore, usually the total amount of less than 10 at. % is desirable. According to the additive elements, it is desirable to choose the total amount at less then 5 at. %, less than 3 at. %, etc.

In this invention, the desirable average particle size of a R—Fe—B type alloy powder is 1~10 μm. When the average particle size of the alloy powder is less than 1 μm, due to the increased surface area of the alloy powder, as kneading ingredients the volumetric ratio of binder additives to the alloy powder must be increased to 1:1.2, which lowers the sintered density of the sintered product after the injection molding to 95% and not desirable. Also, when the average particle size exceeds 10 μm, the particle size is too large wherein the sintered product density saturates around 95%, and it is not desirable since the said density does not increase. The most desirable particle size range is 1~6 μm.

Also, as a R—Fe—B type alloy powder, wherein the main phase alloy powder with the average particle size of 1~5 μm which comprises the principal component of 12 at. %~25 at. % R (provided that R contains at least one of rare earth elements including Y),4at. %~10at. % B, 0.1 at. %~10at. % Co, and 68 at. %~80 at. % Fe and at least 2 phases of the R2Fe14B phases and R rich phase; and the liquid phase alloy powder with the average particle size of 8~40 μm which comprises the intermetallic alloy compound phase including $R_3Co$ between Co and R or Fe and R, partly $R_2(FeCo)_{14}B$, and 20 at. %~45 at. % R (provided that R contains at least one rare earth element including Y), 3 at. %~20 at. % Co, less than 12 at. % B, and the rest Fe are,mixed at a specified ratio. After mixing these powders the resultant alloy powder with the average particle size of less than 20 μm can be used.

At the same the average particle size of two kinds of the raw materials is altered utilizing these alloy powder, by adding the excess amount of R ingredients discounting the oxides generation by rare earth elements, and by adding the excess liquid phase alloy powder, it is possible to generate sufficient amount of the liquid phase during the sintering process; thus, it can prevent the reaction between the R ingredients and the binder which degrades magnetic characteristics.

In the above composed alloy powder, in order to obtain the main phase alloy powder, if the R content is less than 12 at. % it increases the α-Fe phase during the alloy melt which is not desirable; when the R content exceeds 25 at. %, the residual magnetic flux density (Br) decreases; therefore, the R content is desirable to be 12 at. %~25 at. %.

Also, when the B content is less than 4 at. %, the high coercive force (Hc) can not be obtained, and when it exceeds 10 at. % the residual magnetic flux density (Br) decreases; therefore, the B content is desirable to be 4 at. %~10 at. %.

When the amount of Co in the main phase alloy powder exceeds 0.1 at. %, it has the effect of lowering the oxygen content in the raw material. Also, when the amount of Co exceeds 10 at. %, it replaces Fe in the $R_2Fe_{14}B$ phase and decreases the coercive force; therefore, when the Co content is desirably between 0.1 at. %~10 at. %.

Furthermore, the remainder comprises Fe and unavoidable impurities. When the amount of Fe is less than 68 at. %, it becomes relatively rich in rare earth elements. When the amount of Fe exceeds 80 at. %, the remainder Fe portion excessively increases, and rare earth elements relatively decrease. It results in relative depletion of rare earth elements due to the oxidative reaction with a binder. Rare earth elements are necessary for the liquid phase sintering, so that the desirable Fe amount range is 68 at. %~80 at. %.

To the main phase alloy powder, 4 wt %~20 wt % of the R rich phase can be added together with the main phase of the $R_2Fe_{14}B$ phase, in order to improve the sintering ability and to improve the residual magnetic flux density(Br) after sintering.

The liquid phase compound powder made of the intermetallic compound phase (a part of Co or the most of it can be replaced by Fe) between Co and R or Fe and R containing $R_3Co$ phase comprises the $R_3Co$ phase or a phase wherein a part of Co in the $R_3Co$ phase of $R_3Co$ phase is replaced by Fe. The central phase comprises either of $RCo_5$, $R_2Co_7$, $RCo_3$, $RCo_2$, $R_2Co_3$, $R_2Fe_{17}$, $RFe_2$, $Nd_2Co_{17}$, $Dy_6Fe_2$, DyFe, etc., and the above mentioned intermetallic compound phase, $R_2(Fe_2Co)_{14}B$, and $R_{1.11}(FeCo)_4B_4$, etc.

The composition of the liquid phase compound powder, as stated above, according to the kind and quantity of rare earth elements in the objective composition, changes the rate of amount of rare earth elements in the intermetallic compound. However, if the R content is less than 20 at. %, when it is combined with the main phase alloy powder to manufacture a magnet, R is not supplemented sufficiently for the depletion of R due to partial oxidations of R in the main phase alloy powder, which results in insufficient generation of the liquid phase during the sintering. Also, when it exceeds 45 at. %, it has an undesirable effect of increasing the oxygen content.

Also, in order to make the above mentioned compound, the Co concentration of more than 3 at. % is necessary, but when it exceeds 20 at. % the coercive force declines. Therefore, 3~20 at. % is appropriate for the Co, and rest can be replaced by Fe.

Furthermore, when the B content exceeds 12 at. %, it is not desirable since the B-rich phase and the Fe—B compound, etc. exist in excess in addition to the $R_2(Fe_2Co)14B$ phase.

Furthermore, by adding at least one of these elements from Cu, S, Ni, Ti, Si, V, Nb, Ta, Cr, M o, W, Mn, Al, Sb, Ge, Sn, Zr, Hf, Ca, Mg, Sr, Ba, and Be to the main phase alloy powder and/or the liquid phase alloy powder which comprises the intermetallic compound phase between Fe and Rcontaining $R_3Co$ and the $R_2(FeCo)_{14}B$ phase, etc., it is possible to improve a permanent magnet with higher coercive force, higher corrosion resistance, and better temperature characteristics. These additives, too, as the additives mentioned above, the total amount of less than 10 at. % is desirable. The total amount of less than 5 at. % and less than 3 at. %, etc. can be selected according to the additive.

In the alloy powder composition of above, if the average particle size of the main phase alloy powder is less than 1 μm, the surface area of the alloy powder increases. Thus, it is necessary to increase the volumetric ratio of the binder additive to the alloy powder to 1:1.2, but this is not desirable since it lowers the sintered density of the sintered product after the injection molding to around 95%. Also, when the average particle size exceed 5 μm, the sintered density saturates around 95 % due to a large particle size, and the improved density can not be obtained. The desirable average particle size rang is 1~5 μm.

On the other hand, when the average particle size of the liquid phase compound powder is less than 8 μm, the reaction with the binder is about same as the alloy powder (the average particle size of 1~10 μm) with a uniform composition, no effects of additives to the main phase alloy powder is observed. Also, when the average particle size of the liquid phase compound powder exceeds 40 μm, the reaction with the binder is considerably inhibited; however, the sintering ability during the sintering process, and the sintered density and the coercive force decrease. Therefore, the desirable average particle size of the liquid phase alloy powder is 8~40 μm.

Also, the main phase alloy powder and the liquid phase compound powder can be mixed with the 70~99:30~1 ratios; furthermore, 70~97:30~3 is desirable, and the alloy powder with the multiple compositions suitable for the magnetic characteristics can be obtained. By mixing at these composition rate, the main phase alloy powder with the average particle size of 1~5 μm and the liquid phase alloy powder with the average particle size 8~40 μm in these ratios, the total average particle size of the combined powder is less than about 20 μm, preferably less than about 10 μm, which is equal to the aforementioned uniformly composed alloy powder.

For the alloy powder which combines two kinds of powder in the same way mentioned above, the main phase alloy powder and the liquid phase compound powder, the main phase alloy powder with the average particle size 1~5 μm wherein the $R_2Fe_{14}B$ phase is the main phase which comprises 11 at. %~13 at. % R (provided that R contains at least one rare earth element including Y), 4 at. %~12 at. % B, the remainder Fe and unavoidable impurities, and the liquid phase alloy powder with the average particle size of 8~40 μm which comprises the intermetallic alloy powder phase between Co and R or Fe and R containing $R_3Co$ phase and partially $R_2(FeCo)_{14}B$ phases, etc., 18 at. %~45 at. % R (provided that R contains at least one rare earth element including Y), less than 12 at. % B, the remainder Co (a part of Co or most of it can be replaced by Fe) and unavoidable impurities.

In this alloy powder, it is not desirable for the R rich phase to exist in the main phase alloy powder, and it is desirable to have the R rich phase less than 4 wt % of the main phase alloy powder.

Furthermore, in this alloy powder, too, when the main phase alloy powder and the liquid phase alloy powder are mixed, it is desirable to have the similar average particle sizes and the mixing ratio to the mixed powder explained above.

As a manufacturing method of the above R—Fe—B type alloy powder, by selecting an optimal method from the melt-powdering method, the rapid chilling method, the direct reduction diffusion method, the hydrogen inclusion disintegration method, and the atomization method, the alloy powder with a specified average particle size can be obtained.

Whichever R—Fe—B type alloy powder is utilized, by selecting from the optimal range of particle size for each system, in comparison to the usual transition metal powder for the injection molding, for example, Fe based alloy powder and Co based alloy powder, the average particle size is reduced one severalth to one tenth; and, in comparison to a binder additive utilized in the injection molding of the said transition metal powder, the amount of additives can be dramatically reduced.

In this invention, coating the above alloy powder by resin contributes to the control of the reaction between water and R elements after kneading of a binder, and control of the reaction between water and R elements during the gelation step at molding and the dehydration treatment after injection molding, and it is effective to stabilize and reduce the residual oxygen.

As a resin to coat the R—Fe—B type alloy powder, it is desirable to utilize independently or in combinations of methacryl resins: polymethyl methacrylate (PMMA) and polymethylacrylate (PMA) etc.; and thermoplastics: polypropylene, polystyrene, polyvinylacetate, polyvinylchloride, polyethylene, and polyacrylonytrile, etc.

As far as the desirable amount of additives, 0.30 wt % of the alloy powder, which is equivalent to the resin coating film thickness of 50Å~200 is desirable. When additives exceed 0.30 wt %, it is not desirable since the residual oxygen increases from the resin film. On the other hand, since carbon contained in the coating resin can be eliminated by the debinder process in the hydrogen atmosphere as will be explained later, the residual carbon content does not increase in the molded body even the amount of coating resin increases.

As methods of coating, there are the usual mechanofusion system, or the hybridization system, and the method utilizing the ball mill. The desirable coating resin particle size is about 1000Å~5000Å.

The alloy powder thus obtained, since it is relatively stable due to its oxygen content, it has the advantage of being able to recycle during the injection molding. Also, the coated alloy powder has the advantage of being able to injection mold without adding a lubricant.

Furthermore, when the raw material powder comprises the main phase alloy powder and the liquid phase alloy powder which comprises the intermetallic compound phase between Co and R or Fe and R containing $R_3Co$, and a $R_2(FeCo)_{14}B$ phase, etc., the above resin coating can be applied to the main phase phase alloy powder and/or the liquid phase alloy powder. Furthermore, the above resin coating can be applied after the main phase alloy powder is coated with the liquid phase alloy powder by the mechanofusion system; and the same effects as above are obtained in these cases.

Also, in order to maximally inhibit the reaction between the R content of the magnetic powder particle and the binder, when the R—Fe—B type alloy powder which comprises the above main phase alloy powder and the liquid phase alloy powder, a specified amount of transition metal pulverized powder is mixed with the said alloy powder; and after the surface of magnetic powder particles is coated with the transition metal pulverized powder by the mechanofusion process in the inert atmosphere, coating is made fine and uniform by the surface diffusion through the heat treatment. Thus, the raw material powder in which the R content the magnetic powder particle and the binder are completely separated by the said coating can be utilized.

As transition metals for this coating, transition metals excluding rare earth elements, among which Fe, Ni, and Cu are desirable. Particularly, the Fe element is most desirable because it is most contained in the R—Fe—B type magnetic powder. If the content of the magnetic powder is adjusted in advance, no limit exists in the amount of the additive, and it is easy to form a relatively uniform coating around magnetic particles during the mechanofusion treatment due to its superior malleability. The Fe element is also relatively easy to obtain.

Also, even the transition metal powder reacts with the binder to form carbide and oxide compound, since they can be easily de-oxygenated and de-carbonized in vacuum at a relatively low temperature or by the momentary hydrogen stream, it is an ideal coating for the injection molded R—Fe—B type sintered magnet alloy powder.

Furthermore, if the average particle size of the transition metal powder of adhesion or coating is less than 0.02 μm, the transition metal powder itself becomes very reactive to form oxides and lacks metal's characteristic malleability. When the average particle size exceeds 1 μm, the pulverized transition metal powder does not sufficiently adhere to magnetic powder particles by the mechanofusion during the coating treatment, and defects are likely to occur in the coating film. Thus, the desirable particle size is 0.02 μm~1 μm.

By further treatment the surface of magnetic powder particles which contain the film of the transition metal explained above with resin coating,the reaction between the R content in magnetic powder particles and the binder and water can be further reduced. Thus, it is possible to obtain a R—Fe—B sintered magnet which has superior magnetic characteristics.

In this invention, water is added to methylcellulose or agar which goes through the sol-gel transformation, or the combination of them, as the injection molding binder.

When methylcellulose is used solely as a binder, if the amount is less than 0.05 wt % the molding strength is drastically reduced. Also, if the amount exceeds 0.50 wt %, the residual carbon and oxygen increase and magnetic characteristics degrade due to the lower coercive force. From these considerations, 0.05 wt %~0.50 wt % is desirable. Furthermore, 0.1 wt %~0.45 wt % is desirable, and 0.15 wt %~0.4 wt % is most desirable.

When agar is used solely as a binder, if the amount is less than 0.2 wt % the molding strength is drastically reduced. Also, if the amount exceeds 4.0 wt %, the residual carbon and oxygen increase and magnetic characteristics degrade due to the lower coercive force. From these considerations, 0.2 wt %~4.0 wt % is desirable. Furthermore, 0.5 wt %~3.5 wt % is desirable, and 0.5 wt %~2.5 wt % is most desirable.

When methylcellulose and agar are used together as a binder, if the amount is less than 0.2 wt %, the molding strength is drastically reduced, and the mold releasing property between the molding die and the molded body degrades. Also, if the amount exceeds 4.0 wt %, the sintered density after sintering decreases, the residual carbon and oxygen increase, and magnetic characteristics degrade. From these considerations, 0.2 wt %~4.0 wt % is desirable. Nevertheless, it is not desirable for the methylcellulose amount to exceed the amount when methylcellulose is solely used. Also, the total amount is desirable to be less than 3.5 wt % and less than 2.5 wt %.

In this invention, it is characterized in utilizing methylcellulose and/or agar together with water as a binder, and it is desirable to use deionized water which is deoxygenated to control its reaction with R.

When methylcellulose is solely used, if the water content is less than 6 wt %, the fluidity in molding degrades, and short shots are likely to occur. When the water content exceeds 16 wt %, as the total binder amount increases, the sintered density after sintering lowers, the residual oxygen increases, and magnetic characteristics degrade. Thus, the water content of 6~16 wt % is most desirable.

When agar is solely used, if the water content is less than 8 wt %, the fluidity in molding degrades, and short shots are likely to occur. When the water content exceeds 18 wt %, as the total binder content increases, the sintered density after sintering lowers, the residual oxygen increases, and magnetic characteristics degrade. Thus, the water content of 8~18 wt % is most desirable.

Also, when methylcellulose and agar are used together, the water content is selected within the range of 6~18 wt % giving consideration of methylcellulose and agar proportions.

As generally well known, when agar is dissolved in water and heated to around 95° C., it becomes the soluble and viscous sol material. When it is cooled to less than around 40° C., it becomes flexible gel material and solidifies.

On the other hand, when methylcellulose is dissolved in water and heated to around 50° C., it becomes the soluble and viscous sol material. When it is heated to more than around 70° C., it becomes flexible gel material and solidifies. Thus, it shows the reverse sol-gel reaction in comparison to the agar binder.

Utilizing the properties of both, for example, when the agar binder as the principal component, addition of a small quantity of methylcellulose can improve the viscosity of the sol at around 80° C. Therefore, it is possible to reduce the amount of the agar binder to a fraction by adding solely a small quantity of methylcellulose.

Thus, a small quantity of the agar binder can generate the viscoelasticity though it contains a large amount of water, so that the carbon content in the total binder is drastically reduced as the injection molding binder.

Furthermore, since nearly all water is eliminated by the dehydrogen treatment utilizing the freeze vacuum dry method, and at the temperature where the R—Fe—B powder is activated, the oxygen generated by a large amount of water is eliminated, the oxidation of the R—Fe—B alloy powder is largely controlled.

Also, it is effective to add at least one kind of lubricant out of glycerine, wax emulsion, stearic acid and water soluble acrylic resin. When the binder is either methylcellulose or agar, and if the amount of lubricunt is less than 0.10 wt %, the density of molded body tends to be uneven. Particularly, when methylcellulose is utilized solely, and the amount exceeds 0.3 wt %, the molded body strength lowers so that 0.10 wt %~1.0 wt % is desirable. When agar is utilized solely, and the amount exceeds 1.0 wt %, the molded body strength lowers so that 0.1 wt %~1.0 wt % is desirable. When methylcellulose and agar are utilized together, the additive amount of the 0.1 wt %~1.0 wt % range is selected, giving consideration to the methylcellulose and agar ratio.

Although the injection condition changes according to the amount of the binder additives, when methylcellulose is utilized solely, the die temperature of 70° C.~90° C. is desirable. If the temperature is less than 70° C., when the molded body is removed deformation might take place due to the insufficient solidification. Also, when it exceeds 90° the fluidity of the kneaded body deteriorates.

Also, when agar is utilized solely the die temperature of 10° C.~30° C. is desirable. If the temperature is less than 10° C., the fluidity of the kneaded body deteriorates. If it exceeds 30 C. the molded body might deform, when it is being removed due to the insufficient solidification.

Also, when methylcellulose is utilized solely, the injection temperature of 0°~40° C. is desirable. At the temperature less than 0° C. the mixture freeze so that the fluidly lowers. Also, when it exceeds 40° C. the fluidity becomes insufficient so that a short shot is likely to occur and not desirable. Also, when agar is utilized solely, the injection temperature of 75°~95° C. is desirable. If it is less than 75° C., the fluidity is not sufficient so that a short shot is likely to occur. Also, if it exceeds 95° C., bubbles due to water evaporation generate so that it causes void in the sintered body after sintering. Also, water evaporation lowers the fluidity of the kneaded body so that the said body clogs up the molding equipment and is not desirable.

Also, if the injection molding pressure is less than 30 kg/cm$^2$, a weld generates the uneven molded density, after sintering bend and wariness generate. Also, when methylcellulose is utilized solely, when it exceeds 50 kg/cm$^2$ flare generates and is not desirable, and 30~50 kg/cm$^2$ is desirable. Also, when agar is utilized solely and the pressure exceeds 70 kg/cm$^2$, a flare is generated and is not desirable, so that the pressure of 30~70 kg/cm$^2$ is desirable.

Therefore, when methylcellulose and agar are utilized together, considering the ratio of, methylcellulose and agar the die temperature, the injection temperature, and the injection molding pressure, etc., can be selected from the above range.

In order to obtain a sintered anisotropic magnet, if the magnetic field during the injection molding is less than 10 kOe, the magnetic orientation is insufficient, so that the injection molding in the magnetic field of above more than 10 kOe is desirable.

In this invention, the dehydration treatment is applied as a pre-processing step for the debinder treatment, but the dehydration method is not specified. For example, in the heat drying method, the temperature varies according to the added amount of deionized water, but it is desirable to heat in the temperature range 20° C.~100° C. at 30°~60° C./hr . If the rate is less than 30° C./hr, the finished product generates fractures and cracking due to rapid evaporation of water and is not desirable.

Particularly, when the processing product is small, it is desirable to raise the temperature at 40°~60 C./hr at least in the 20°~100°C. range, and the dehydration process can be simplified. Also, by the time temperature reaches 100° C. the most of water evaporates, so that the dehydration treatment is excess of the 100° C. range is not necessary.

Also, in order to apply the dehydration treatment continuously from low temperature to high temperature and also to control the oxidation of a R—Fe—B type alloy powder, it is desirable to have the dehydration environment of at less than $1\times10^3$ Torr in vacuum.

As generally known, since this invention is concerned about the R—Fe—B type alloy powder which contains rare earth elements (R) as the principal component, it easily reacts with the atmospheric oxygen or oxygen in water. Thus, instead of the dehydration treatment by the above heat drying method, the water molecules in the binder is vaporized instantaneously from ice, the solid state, by the freeze vacuum dry method. Thus, the reaction between the R component of the R—Fe—B type alloy powder and oxygen in water can be controlled, and the residual oxygen in the molded body or the finally obtained sintered body can be dramatically reduced.

In the dehydration treatment of the above freeze vacuum dry method, the cooling rate is not specified; but if the cooling rate is too slow, the molded body might oxidize during the cooling process so that the faster cooling rate is desirable.

The cooling temperature is desirably within the range of −5° C. to −100° C., since if it is higher than −5° C., drying will take a long time, while if it is lower than −100° C., an undesirably rapid increase in electricity used for freezing will occur.

Furthermore, vacuum during the vacuum is desirable to be higher than $1\times10^{-3}$ Torr; and after the freeze vacuum drying, the processed product can slowly be brought back to room temperature.

As the debinder treatment after the dehydration treatment, though a usual vacuum heating method can be utilized, instead of the above method, the temperature is raised at 100°~200 C./hr in the hydrogen atmosphere and kept at 300°~600° C. for 1~2 hour. Thus, nearly all carbon in the methylcellulose and agar binder or coating resins is decarbonized; and, in comparison to the usual paraffin wax and thermoplastic binder, the treatment time is dramatically reduced.

Since the alloy powder containing R elements easily absorb hydrogen, the dehydrogen treatment process is necessary after the debinder treatment in the hydrogen atmosphere. By raising the temperature at 50°~200° C./hr and keeping it at 500°~800° C. for 1~2 hour in vacuum, nearly all absorbed hydrogen can be eliminated.

Furthermore, it is desirable to continue heating the molded body after the dehydration treatment to sinter it. The rate of heating in excess of 500° C. can be selected at will, for example, 100°~300° C./hr, etc. the usual heating method in sintering can be applied.

Particularly, since this invention utilized the methylcellulose and/or agar and water as binder, the carbon content in the binder is initially lowered, so that even the heating rate is increased to, for example, 100°~300° C./hr, the molded body does not generate fractures or crackings. In comparison to the usual binder consisting of paraffin wax and thermoplastics, it has the advantage of shortening time required for the debinder treatment.

The sintering condition of molded body after dehydrating and debindering, and the heat treatment condition after sintering can be selected according to the chosen alloy powder composition, they can be same as the usual manufacturing condition of the R—Fe—B type sintered permanent magnet.

As for the heat-treatment conditions for sintering and after sintering the molded body which was subjected to dehydration and debinding, it is desirable to maintain the sintering process at 1000°~1800° C. for 1-2 hours and maintain the aging process at 450°-800° C. for 1-8 hours.

In this invention, since the R—Fe—B alloy powder with specified average particle size is injection molded utilizing a specified amount of methylcellulose and/or agar binder, the drastic reduction of carbon and oxygen in the molded body after debinder is possible. Thus, it is possible to minimize the amount of carbon and oxygen in the finished sintered body product.

That is to say, the upper limits of carbon and oxygen contained in the sintered body can be less than 1300 ppm carbon, less than 10000 ppm oxygen; furthermore less than 1000 ppm carbon, less than 9000 ppm oxygen; particularly, under the best conditions, the carbon content can be made less than 800 ppm and the oxygen content less than 8000 ppm. Thus, the sintered magnet with superior magnetic characteristics can be obtained.

Therefore, the maximum energy product of more than 4 MGOe, more than 10 MGOe, more than 15 MGOe can be obtained according to each condition; and more than 20 MGOe can be obtained under the best conditions.

In this invention, the injection molding kneaded mixture which comprises the R—Fe—B type alloy powder and the binder in which methylcellulose and/or agar and water are principal components, the molded body which is molded from the said mixture by injection molding machine, the excess produced during the molding called spoul and runner can be frozen and stored airtightly so that the reaction between the R content of the R—Fe—B type alloy powder and water can be controlled. Thus, prior to proceeding to the next process of molding or sintering, or for utilizing them as a recycled materials, storing for a period of time or a long duration will not increase the residual oxygen in the said mixture or the molded body. The amount of residual oxygen and residual carbon drastically reduces in the final sintered product, so that and the R—Fe—B type permanent magnet with the stable magnetic properties can be supplied.

Also, since they are kept in air tight condition, and evaporation of water in the mixture and the molded body can be prevented, the fluidity of the said mixture will not change after thawing it. Furthermore, since thawing can be accomplished at room temperature, and the recycling raw material can be efficiently utilized, the final product of the R—Fe—B sintered permanent magnet can be supplied at low cost.

EXAMPLE

EXAMPLE 1

An alloy ingot consisting of 16.5 at % Nd as R, 5.7 at % B, and the remainder Fe and unavoidable impurities was subjected to the high frequency heating to melt the button-shaped alloy in the Ar gas atmosphere. After the alloy was coarsely crushed, it was pulverized by a jet mill to obtain the average particle size of 3 μm and 7 μm. The obtained alloy powder was kneaded with the commercially available methylcellulose and agar powder as the binder and water, or further with additives shows in Table 1 at room temperature.

This kneaded pellet was molded at the injection temperature and the die temperature shown in table 1 to obtain a 20 mm×20 mm×3 mm plate in the magnetic field (15 kOe).

The obtained molded body was heated from room temperature to 100° C. at 50° C./hr in vacuum, and was kept at this temperature for 1 hour. After completely dehydrating it, the temperature was raised to 500°C. at 100° C./hr for the debinder treatment. It was further heated to and kept at 1100° C. for one hour to sinter.

After completion of sintering, the Ar gas was introduced to cool the sintered body to 800 C. at 7° C./min.; then, it was cooled to 550° C. at 100° C./hr, and was kept for 2 hours for aging.

No cracking, fractures and deformation, etc. in the obtained sintered body were observed. The characteristics of the Nd—Fe—B sintered alloy obtained utilizing this process were shown in Table 2.

For the comparison study, an acrylic binder is mixed with the alloy powder with the average particle size of 3 μm as a Example 1 to the 1:1 volumetric ratio. After kneading it at 160° C. for 10 minutes and making it to a injection molding knead, it was injection molded into the die heated at 45° C. in the magnetic field of 15 kOe, to produce a injection molded body, a 10 mm length×10 mm width×5 mm height plate by the usual method.

After the injection molded body was heated to 350 C. at 6° C./hr to debinder in vacuum of $3\times10^4$ Torr, it was sintered and heated under the same condition as in Example 1 to obtain a sintered anisotropic magnet. The measurement results of magnet characteristics, the residual oxygen content, and the residual carbon content were shown in Table 2.

As it is obvious from Table 2, when methylcellulose or agar is used as a binder, comparing to the usual method of utilizing an acrylic organic binder, the residual carbon residual oxygen in the sintered body were drastically reduced; thus, it had superior magnet characteristics.

When methylcellulose and/or agar was used as a binder, since it contains a large amount of water, the carbon content in the total binder was kept very low; and since the main content of the binder is water, and at the temperature where the R—Fe—B alloy powder becomes active, water has already evaporated, the oxidation was significantly controlled. The resultant residual carbon and residual oxygen were drastically reduced.

Also, it was obvious when the average particle size was 7 μm, it had the lower residual carbon and residual oxygen content than the average particle size was 3 μmm. But the magnetic characteristics were slightly poor, it seems that the density of sintered body after sintering a little reduced since the density of molding body reduced in case the average particle size was bigger.

TABLE 1

| No. | Average particle size | Binder | Water | Additives | Injection temperature Die temperature |
|---|---|---|---|---|---|
| 1 | 3 μm | Methylcellulose 0.4 wt % | 12.0 wt % | — | 25° C. 80° C. |
| 2 | 3 μm | Methylcellulose | 10.0 wt % | Glycerine | 25° C. |

TABLE 1-continued

| No. | Average particle size | Binder | Water | Additives | Injection temperature Die temperature |
|---|---|---|---|---|---|
| | | 0.2 wt % | | 0.1 wt % | 80° C. |
| 3 | 7 μm | Methylcellulose | 10.0 wt % | Glycerine | 25° C. |
| | | 0.2 wt % | | 0.1 wt % | 80° C. |
| 4 | 3 μm | Methylcellulose | 12.0 wt % | Glycerine | 80° C. |
| | | 0.2 wt % | | 0.1 wt % | 25° C. |
| | | Agar 0.7 wt % | | | |
| 5 | 3 μm | Agar | 12.0 wt % | Glycerine | 90° C. |
| | | 2.0 wt % | | 0.1 wt % | 20° C. |

TABLE 2

| No. | Residual oxygen content (ppm) | Residual carbon content (ppm) | Br(kG) | iHc(kOe) | (BH)max (MGOe) |
|---|---|---|---|---|---|
| 1 | 7500 | 780 | 9.5 | 12.2 | 21.0 |
| 2 | 7800 | 820 | 9.6 | 13.0 | 21.4 |
| 3 | 7000 | 750 | 9.0 | 15.2 | 19.6 |
| 4 | 7600 | 800 | 9.5 | 10.8 | 20.1 |
| 5 | 8800 | 1100 | 8.4 | 6.3 | 12.3 |
| Comparison Study | 14300 | 6800 | 2.8 | 0.8 | 0.8 |

EXAMPLE 2

300 g of alloy powder composed of the pulverized powder having an average particle size of 3 μm and consisting of $Nd_{16.5}N_{6.2}Fe_{bal}$ as obtained in Example 1 with an addition of 0.20 wt % hydrophobic polymethylmethacrylate (PMMA) having an average particle size of 0.15 μm, was placed in the mechanofusion system tank; and while the temperature was kept at 70° C., the tank was rotated at maximum speed of 1800 rpm for 10 minutes to resin coat (film thickness of about 100Å) the pulverized powder. Utilizing two kinds of the non-coated alloy powders and resin coated alloy powders obtained above, in the same manner as in Example 1, the binder, water, additives which kind and quantity is shown to Table 3 were added and kneaded at room temperature; and the obtained kneaded pellets were injection molded at the injection molding temperature and the die temperature shown in Table 3 to obtain a 20 mm×20 mm×3 mm plate in the magnetic field (15 kOe). Moreover, glycerine was used as an additive.

As a dehydration treatment of the molded body, one of the following methods were utilized: the heat dry method wherein the molded body is heated from room temperature to 100° C. at 50° C./hr in vacuum and kept at this temperature for 1 hour to completely to dehydrate it; and the freeze vacuum dry method wherein the said molded body was rapidly chilled to −50° C. and kept at the said temperature for 24 hours to completely dehydrate it. Next, it was subjected to the debinder treatment: after it was brought back to room temperature, it was heated from room temperature to 500° C. at 150° C./hr and kept at 500° C. for 1 hour in hydrogen atmosphere; furthermore, in order to eliminate the absorbed hydrogen, it was heated in vacuum from room temperature to 500° C. at 150° C./hr and kept at this temperature for 1 hour to completely dehydrate it; then, it was sintered under the same conditions as in Example 1, and the aging treatment was applied.

Moreover, whether the resin coating was present or not, the kind of binder applied, the amount of additives, the kind of the dehydration treatment utilized in each magnet are shown in Table 3. Also, the example of Sample No. 9 had a different composition, $Nd_{14.5}B_{6.5}Fe_{bal}$ from other examples.

No cracking, fracture, and deformation etc. were observed in the obtained sintered magnet, and it possesses the residual oxygen, the residual carbon, and magnetic characteristics shown in Table 4. By debindering the injection molded body in the hydrogen atmosphere, since nearly all carbons in methylcellulose and/or agar or coating resin were eliminated, magnetic characteristics improved.

Regardless of the kind of binders utilized, it is believed that the alloy powder coated with resin significantly controlled oxidations reducing the residual oxygen.

TABLE 3

| No. | Resin coat | Binder | Water wt % | Glycerine additive quantity | Injection temperature Die temperature | Dehydration treatment |
|---|---|---|---|---|---|---|
| 6 | X | Methylcellulose | 10.0 | 0.1 wt % | 25° C. | vacuum |
| | | 0.2 wt % | | | 80° C. | heating |
| 7 | X | Methylcellulose | 10.0 | 0.1 wt % | 25° C. | freeze dry |
| | | 0.2 wt % | | | 80° C. | |
| 8 | ○ | Methylcellulose | 10.0 | 0.1 wt % | 25° C. | freeze dry |
| | | 0.2 wt % | | | 80° C. | |
| 9 | X | Methylcellulose | 12.0 | 0.1 wt % | 80° C. | freeze dry |
| | | 0.2 wt % | | | 25° C. | |
| | | Agar 0.7 wt % | | | | |
| 10 | X | Agar 2.0 wt % | 12.0 | 0.2 wt % | 90° C. | vacuum |
| | | | | | 20° C. | heating |
| 11 | X | Agar 2.0 wt % | 12.0 | 0.2 wt % | 90° C. | freeze dry |
| | | | | | 20° C. | |
| 12 | ○ | Agar 2.0 wt % | 12.0 | 0.2 wt % | 90° C. | freeze dry |
| | | | | | 20° C. | |

TABLE 4

| No. | Residual oxygen content (ppm) | Residual carbon content (ppm) | Br(kG) | iHc(kOe) | (BH)max (MGOe) |
|---|---|---|---|---|---|
| 6 | 7700 | 620 | 9.2 | 14.5 | 20.3 |
| 7 | 7300 | 600 | 9.4 | 14.0 | 21.2 |
| 8 | 7000 | 850 | 9.5 | 13.4 | 21.7 |
| 9 | 7650 | 820 | 9.4 | 12.6 | 21.3 |
| 10 | 8700 | 820 | 8.9 | 9.6 | 17.4 |
| 11 | 8000 | 800 | 9.2 | 11.3 | 19.3 |
| 12 | 7100 | 840 | 9.2 | 11.0 | 20.3 |

EXAMPLE 3

An alloy ingot consisting or 12.0 at % Nd and 0.3 at % Pr as R, 7.0 at % B, and the remainder Fe and unavoidable impurities was subjected to the high frequency heating to melt the button-shaped alloy in the Ar gas atmosphere and was coarsely crushed. After the button was coarsely crushed by the jaw crusher etc. to the average particle size of about 15 μmm, it was further pulverized by a jet mill to obtain the main phase alloy powder with the average particle size of 3 μm. Another ingot consisting of 20.1 at % Nd, 0.9 at % Pr, 1.1 at % Dy, 15.0 at % Co, 4.5 at % B, the remainder Fe was melted by the high frequency heating in the Ar atmosphere to obtain a button shaped ingot alloy. It was coarsely crushed by the jaw crusher, etc. to obtain the liquid phase alloy powder with the average particle size of about 14 μm. The main phase alloy phase powder and the liquid phase alloy powder were combined at 90:10 weight ratio and mixed.

The analytical data of this mixed powder is as follows: 13.9 at % Nd, 0.45 at % Pr, 0.26 at % Dy, 3.6 at % Co, 6.4 at % B, and the remainder Fe.

Utilizing the mixed alloy powder, as in Example 1 the same kind and quantity of binders, water, additives as in Table 5 were added and kneaded at room temperature. The obtained kneaded pellets were injection molded at the injection temperature and the die temperature shown in Table 5 to obtain a 20 mm×20 mm×3 mm plate in the magnetic field (15 kOe). Moreover, glycerine was utilized as the additive.

As a dehydration treatment of the molded body, one of the following methods were utilized: the heat dry method wherein the molded body is heated from room temperature to 100° C. at 50° C./hr in vaccum and kept at this temperature for 1 hour to completely to dehydrate it; and the freeze vacuum dry method wherein the said molded body was rapidly chilled to −50° C. and kept at the said temperature for 24 hours to completely dehydrate it. Next, it was subjected to the debinder treatment by the vacuum heating method in Example 1; then, it was sintered under the same conditions as in Example 1, and the aging treatment was applied.

Also, utilizing the above mixed alloy powder, the mixed powder wherein 7.0 wt % of the pulverized iron powder with the average particle size of 0.02 μm was added was placed in the mechanofusion system (Hosokawa Micron Ltd., Am-20FV); and after it was filled with Ar gas, while controlling the temperature by water to keep the arm head less than 50° C. during operation, the rolling speed was kept at 700 rpm for 3 hours to obtain Fe powder coated alloy powder. The said alloy powder was injection molded, dehydrated, debindered utilizing the above processes, and sintered.

Moreover, the mechanofusion treated powder was heat treated at 550° C. for 2 hours; in the vacuum environment of $2\times10^{-5}$ Torr and when the obtained powder was studied under the electron microscope, the particle surface of the main phase alloy powder and the liquid phase alloy powder were adhered by dense and smooth Fe particles.

Table 5 shows whether the Fe film present or not, the kind of binders, the amount of additives, and the dehydration method employed in each magnet.

No cracking, fracture and deformation, etc. in the obtained sintered body were observed. The amount of residual oxygen and residual carbon, magnetic characteristics of the Nd—Fe—B sintered alloy obtained utilizing this process were shown in Table 6. Particularly, the magnet which utilized alloy powder coated with Fe powder contained less residual oxygen and residual carbon and with improved magnet characteristics.

TABLE 5

| No. | Fe powder coat | Binder | Water wt % | Glycerine additive quantity | Injection temperature Die temperature | Dehydration treatment |
|---|---|---|---|---|---|---|
| 13 | X | Methylcellulose 0.25 wt % | 13.0 | 0.1 wt % | 25° C.<br>80° C. | vacuum heating |
| 14 | X | Methylcellulose 0.25 wt % | 13.0 | 0.1 wt % | 25° C.<br>80° C. | freeze dry |
| 15 | ○ | Methylcellulose 0.25 wt % | 13.0 | 0.1 wt % | 25° C.<br>80° C. | vacuum heating |
| 16 | X | Agar 2.0 wt % | 12.0 | 0.2 wt % | 90° C.<br>20° C. | vacuum heating |

TABLE 6

| No. | Residual oxygen content (ppm) | Residual carbon content (ppm) | Br(kG) | iHc(kOe) | (BH)max (MGOe) |
|---|---|---|---|---|---|
| 13 | 8500 | 950 | 8.8 | 7.8 | 15.3 |
| 14 | 7200 | 830 | 9.1 | 11.5 | 19.8 |
| 15 | 7300 | 850 | 9.2 | 13.7 | 20.1 |
| 16 | 9000 | 1200 | 8.6 | 6.1 | 12.9 |

EXAMPLE 4

An alloy ingot consisting of the $R_2Fe_{14}B$ phase and the R rich phase (10.5 at % Nd and 3.1 at % Pr as R, 6.6 at % B, 3.0 at % Co, and the remainder Fe and unavoidable impurities) was melted by the high frequency heating to obtain the button-shaped alloy in the Ar gas atmosphere and was coarsely crushed. After the alloy was coarsely crushed b the jaw crusher, etc. to the average particle size of about 15 μm, it was further pulverized by a jet mill to obtain the main phase raw material powder with the average particle size of 3 μm. Another ingot consisting of 19.7 at % Nd, 0.8 at % Pr, 1.1 at % Dy, 15.9 at % Co, 4.5 at % B, the remainder Fe was melted by the high frequency heating in the Ar gas atmosphere to obtain a button shaped ingot alloy. It was coarsely crushed by the jaw crusher, etc. to obtain the liquid phase alloy powder with the average particle size of about 14 μm. The main phase raw material powder and the liquid phase alloy powder were combined at 90:10 weight ratio and mixed.

The analytical data of this mixed powder is as follows: 11.4 at % Nd, 2.82 at % Pr, 0.11 at % Dy, 4.2 at % Co, 6.4 at % B, and the remainder Fe.

To this mixed alloy powder, 0.20 wt % of the commercially available methylcellulose powder as the binder was added and kneaded at room temperature; and while water was added so that the amount of water in the powders became 10 wt %, glycerine was 0.10 wt % added and kneaded at room temperature.

This kneaded pellets were injection molded at the injection temperature of 25° C. and the die temperature kept at 80° C. to obtain a 20 mm×20 mm×8 mm plate in the magnetic field (15 kOe).

This molded body is dehydrated and debindered employing the same dehydration treatment of vacuum heating and the debinder treatment as in Example 1, or the dehydration treatment of vacuum heating or the dehydration treatment of freeze vacuum drying, and the debinder treatment of heating in the hydrogen atmosphere and the dehydrogenation treatment as in Example 2; furthermore, the dehydration treatment of vacuum drying at room temperature, and the debinder treatment of heating in the hydrogen atmosphere and the dehydrogenation treatment then, it was sintered and aged in the same conditions in Example 1.

Table 7 shows the dehydration treatment and the debinder treatment utilized for each magnet.

No cracking, fracture and deformation, etc in the obtain sintered body were observed. The characteristics of the amount of residual oxygen and residual carbon and magnetic characteristics of these sintered magnets were shown in Table 8

TABLE 7

| No. | Dehydration treatment | Debinder treatment |
|---|---|---|
| 17 | vacuum heating | vacuum heating |
| 18 | room temperature vacuum drying | hydrogen atmosphere |
| 19 | vacuum heating | hydrogen atmosphere |
| 20 | freeze dry | hydrogen atmospher |

TABLE 8

| No. | Residual oxygen content (ppm) | Residual carbon content (ppm) | Br(kG) | iHc(kOe) | (BH)max (MGOe) |
|---|---|---|---|---|---|
| 17 | 9500 | 1300 | 9.4 | 5.6 | 15.5 |
| 18 | 9500 | 720 | 9.7 | 11.6 | 22.3 |
| 19 | 7900 | 580 | 10.3 | 17.8 | 25.5. |
| 20 | 7100 | 650 | 10.1 | 14.1 | 24.7 |

We claim:

1. A process for preparing an injection molded R—Fe—B type sintered magnet, comprising the steps of:

mixing and kneading R—Fe—B type alloy powder wherein R is at least one species of rare earth elements including Y, a binder selected from the group comprising methylcellulose, agar and water and mixture thereof, wherein the group undergoes a solgel reaction at a predetermined temperature, and water;

molding the thus obtained mixture by injection-molding in a magnetic field;

dehydrating the molded mixture;

subjecting the dehydrated mixture to a debinder treatment; and sintering the thus treated mixture.

2. The process as claimed in claim 1, wherein the alloy powder consisting mainly of 8 at. %~30 at. % of R which is at least one species of the rare earth elements including Y, 42 at. % −90 at. % of Fe and 2 at. % −28 at. % of B and having an average particle size of 1–10 μm is used.

3. The process as claimed in claim 2, wherein the alloy powder having an average particle size of 1–6 μm is used.

4. The process as claimed in claim 3, wherein the alloy powder in which less than 50% of Fe is substituted by Co is used.

5. The process as claimed in claim 2, wherein the alloy powder in which less than 50% of Fe is substituted by Co is used.

6. The process as claimed in claim 1, wherein a mixture composed of an alloy powder mixed with a liquid phase compound powder in a predetermined proportion is used as the starting material, said alloy powder consisting mainly of 12 at. % of R which is at least one species of rare earth elements including Y, 4 at. % of B, 0.1 at. %–10 at. % of Co and 68 at. %~80 at. % of Fe and having at least two phases of $R_2Fe_{14}B$ phase and R-rich phase and an average particle diameter of 8–40 μm, said liquid phase compound powder including an $R_2(FeCo)_{14}B$ phase in a part of an intermetallic compound phase between Co or Fe and R including an $R_3Co$ phase, and consisting of 20 at. %–45 at. % of R which is at least one species of rare earth elements including Y, 3 at. %–20 at. % of Co, less than 12 at. % of B and balance Fe and having an average particle diameter of 8–40 μm.

7. The process as claimed in claim 1, wherein a mixture composed of an alloy powder mixed with a liquid phase compound powder is used as a starting material, said alloy powder having mainly an $R_2Fe_{14}B$ phase consisting of 11 at. %–13 at. % of R which is at least one species of rare earth elements including Y, 4 at. %–12 at. % of B, balance Fe and inevitable impurities and having an average particle diameter of 1–5 μm, said liquid phase compound powder including an $R_2(FeCo)_{14}B$ phase in a part of an intermetallic compound between Co or Fe and R including an $R_3Co$ phase, and consisting of 13 at. %–45 at. % of R which is at least one species of rare earth elements including Y, less than 12 at. % of B, balance Co which can be partly or mostly substituted by Fe and inevitable impurities and having an average particle diameter of 8–40 μm.

8. The process as claimed in claim 7, wherein the mixture composed of said alloy powder and said liquid phase compound powder is mixed with a predetermined amount of a transition metal powder and the thus obtained mixture is subjected to a heat treatment to cause said transition metal to be deposited or diffusely coated on the surfaces of said alloy metal powder and liquid phase compound powder.

9. The process as claimed in claim 6, wherein the mixture composed of said alloy powder and said liquid phase compound powder is mixed with a predetermined amount of a transition metal powder and the thus obtained mixture is subjected to a heat treatment to cause said transition metal to be deposited or diffusely coated on the surfaces of said alloy metal powder and liquid phase compound powder.

10. The process as claimed in claim 1, wherein a resin is coated on the surfaces of the Re-Fe-B type alloy powder.

11. The process as claimed in claim 10, wherein the additive amount of the resin is less than 0.30 wt. % with respect to the alloy powder.

12. The process as claimed in claim 1, wherein the content of methylcellulose is in the range of from 0.05 wt. % to 0.50 wt. % and the content of water is in the range of from 6 wt. % to 16 wt. %.

13. The process as claimed in claim 12, wherein the content of methylcellulose is in the range of from 0.1 wt. % to 0.45 wt. %.

14. The process as claimed in claim 13, wherein the content of methylcellulose is in the range of from 0.15 wt. % to 0.4 wt. %.

15. The process as claimed in claim 12, wherein an amount ranging from 0.1 wt. % to 0.3 wt. % of at least one species of glycerin, stearic acid, emulsion wax and water-soluble acrylic resin is added as a lubricant to the binder.

16. The process as claimed in claim 12, wherein the injection molding is carried out at a temperature 70°–90° C. for the mold, at a temperature of 0°–40° C. for the injection and under and injection pressure of 30–50 kg/cm$^2$.

17. The process as claimed in claim 1, wherein the content of agar is in the range of from 0.2 wt. % to 4.0 wt. % and the content of the water is in the range of from 8 wt. % to 18 wt. %.

18. The process as claimed in claim 17, wherein the content of the agar is in the range of from 0.5 wt % to 3.5 wt. %.

19. The process as claimed in claim 18, wherein the content of agar is in the range of from 0.5 wt. % to 2.5 wt. %.

20. The process as claimed in claim 17, wherein an amount ranging from 0.1 wt. % to 1.0 wt. % of at least one species of glycerin, stearic acid, emulsion wax and water-soluble acrylic resin is added as a lubricant to the binder.

21. The process as claimed in claim 17, wherein the injection molding is carried out at a temperature of 10°–30° C. for the mold, at a temperature of 75°–95° C. for the injection and under an injection pressure of 30–70 kg/cm$^2$.

22. The process as claimed in claimed 1, wherein the binder consists of methylcellulose and agar in the range of from 0.2 wt. % to 4.0 wt. % wherein the content of methylcellulose does not exceed 0.5 wt. % at maximum, and the content of water is in the range of from 6 wt. % to 18 wt. %.

23. The process as claimed in claim 22, wherein an amount ranging from 0.1 wt. % to 1.0 wt. % of at least one species of glycerin, stearic acid, emulsion wax and water-soluble acrylic resin is added as a lubricant to the binder.

24. The process as claimed in claim 1, at least one of a freeze-preserved mixture and/on injection molded mixture is used.

25. The process as claimed in claim 1, wherein the magnetic field at the time of injection molding is more than 10 kOe.

26. The process as claimed in claim 1, wherein the dehydration is carried out by temperature-rising drying.

27. The process as claimed in claim 1, wherein the dehydration is carried out by a freeze-vacuum drying.

28. The process is claimed in claim 1, wherein the debinder treatment is carried out by heating vacuum.

29. The process as clawed in claim 1, wherein the debinder treatment is carried out by a heating in a hydrogen stream.

30. The process as claimed in claim 29, wherein a further dehydration is carried out after the debinder treatment.

31. The process as claimed in claim 1, wherein the sintering is carried out at a temperature of 1000° C.–1180° C. for one to two hours.

32. The process as claimed in claim 1, wherein an aging treatment is carried out at a temperature of 450°–800° C. for one to eight hours after the sintering.

33. The process as claimed in claim 1, wherein the sintered mixture contains less than 1300 ppm of carbon and less than 10000 ppm of oxygen.

34. The process as claimed in claim 33, wherein the sintered mixture contains less than 1000 ppm of carbon and less than 9000 ppm o f oxygen.

35. The process as claimed in claim 33, wherein the sintered mixture contains less than 800 ppm of carbon and less than 8000 ppm of oxygen.

* * * * *